United States Patent [19]

Kennicott

[11] Patent Number: 4,988,839

[45] Date of Patent: Jan. 29, 1991

[54] MOMENTUM ACTIVATED ELECTRICAL SWITCH

[76] Inventor: Joseph W. Kennicott, 4708 Huron Dr., Pensacola, Fla. 32507

[21] Appl. No.: 402,772

[22] Filed: Sep. 5, 1989

[51] Int. Cl.[5] ..... H01H 35/14

[52] U.S. Cl. ..... 200/61.45 M; 200/61.53; 200/61.83

[58] Field of Search ..... 200/61.45 R, 61.45 M, 200/61.53, 61.52, 61.83; 335/205, 207

[56] References Cited

U.S. PATENT DOCUMENTS

| | | | |
|---|---|---|---|
| 2,890,303 | 6/1969 | Clurman | 200/61.45 M |
| 2,898,416 | 8/1959 | Clurman | 200/61.45 M X |
| 2,997,557 | 8/1961 | Gillmor et al. | 200/61.53 X |
| 3,132,220 | 5/1964 | Uri et al. | 200/61.45 M X |
| 3,132,221 | 5/1964 | Kachline et al. | 200/61.33 |
| 3,171,913 | 3/1965 | Kersh | 200/61.45 M X |
| 3,529,269 | 9/1970 | Gardiner | 335/207 |
| 3,644,856 | 2/1972 | Scott | 335/207 |
| 3,737,599 | 6/1973 | Zuvelu | 335/205 X |
| 3,748,415 | 7/1973 | Suzuki | 200/61.45 M |
| 4,082,927 | 4/1978 | Beckwith | 200/61.45 M X |
| 4,325,059 | 4/1982 | Jaye | 200/61.83 X |
| 4,409,576 | 10/1983 | Petersen | 335/207 X |
| 4,484,041 | 11/1984 | Andres et al. | 335/205 X |
| 4,513,183 | 4/1985 | Hill | 200/61.83 X |
| 4,639,563 | 1/1987 | Gunther | 200/61.45 M X |
| 4,816,627 | 3/1989 | Janotik | 200/61.45 M |

*Primary Examiner*—J. R. Scott

*Attorney, Agent, or Firm*—Jones, Askew & Lunsford

[57] ABSTRACT

A momentum activated electrical switch. A cylindrical switch body has a movable mass therein constrained to move between a first end, the off position, and a second end, the on position. The movable mass is formed from a magnet and both ends are provided with a ferrous material to provide a force that detains the magnet in position at each respective end until deceleration and momentum moves the magnet to the opposite end. The second end is formed from a non-magnetic and electrically non-conducting material have two (2) ferrous electrically conducting rods that extend therethrough. When the magnet is formed from a non-conducting composition, the face adjacent the second end is provided with a disk of electrically conducting material that completes the circuit.

4 Claims, 1 Drawing Sheet

MOMENTUM ACTIVATED ELECTRICAL SWITCH

BACKGROUND OF THE INVENTION

1. Field of the Invention

The present invention is generally related to electrical switches and in particular to momentum activated switches.

2. General Background

Momentum switches normally contain a restrained movable mass. During sufficient acceleration or deceleration the momentum of the mass exerts a force greater than and in opposition to the restraining force which results in movement of the mass to either close or open the switch.

A variety of switches known to applicant include the following.

U.S. Pat. No. 3,529,269 entitled "Magnetic Switch" discloses an electrical switch having a reciprocating inner magnet carrying a moving contact with the contact being connected to the inner magnet by means of a spring. An externally threaded housing forms a part of an enclosure with contacts therein. An inner magnet-receiving portion opens upon and forms an integral part of the externally threaded housing portion.

U.S. Pat. No. 3,644,856 entitled "Electrical Switch" discloses a switch incorporating circuit terminals and a switch member movable relative thereto so that an electrical circuit may be made upon bringing the same into contact therewith. A permanent magnet is positioned adjacent circuit terminals and a secondary permanent magnet carries the switch member. The magnets are positioned in the electrical switch in opposite polarity so that the magnet fields repel one another and thus normally space the magnet carrying the switch member with respect to the circuit terminals.

U.S. Pat. No. 4,409,576 entitled "Method And Apparatus Which Change Magnetic Forces Of A Linear Motor" discloses the use of magnets that move to open and close a switch.

U.S. Pat. No. 3,132,221 entitled "Vibration Switch" discloses a non-magnetic normally closed switch, that when subjected to linear vibrations of a given frequency and amplitude, breaks an electrical circuit.

U.S. Pat. No. 4,484,041 entitled "Magnetically Actuated Electrical Switch", U.S. Pat. No. 2,890,303 entitled "Inertia Switches", U.S. Pat. No. 3,737,599 entitled "Acceleration Switch With Magnetic Permeable Metal Sleeve For Shunting Magnetic Field", and U.S. Pat. No. 4,639,563 entitled "Acceleration And Deceleration Sensor" disclose magnetically operated switches representative of the art.

U.S. Pat. Nos. 3,737,599; 4,484,041; and No. 4,639,563 all involve activating a reed switch by magnetic means. U.S. Pat. No. 3,644,856 is a momentary contact switch operated manually by a push button such as a doorbell button. U.S. Pat. No. 3,132,221 is operated in response to vibrations. U.S Pat. Nos. 3,529,269, and 4,409,576 are relatively complex switching devices. U.S. Pat. No. 2,890,303 only establishes a momentary electrical contact (a few milliseconds) between two terminals with no detent to hold the switch closed in the on position.

As it can be seen, the known art does not meet the need for a momentum activated switch (not magnetic) with detent provisions to hold the switch in the open or closed position with a minimum of moving and other parts.

SUMMARY OF THE PRESENT INVENTION

The preferred embodiment of the apparatus of the present invention solves the aforementioned problems in a straightforward and simple manner. What is provided is a momentum activated electrical switch. The switch body has a ferrous disk attached at one end and a disk of non-conducting material attached at the opposite end. Two ferrous rods extend through the nonconducting disk into the switch body to serve as contacts on the inside and terminals on the outside. A magnet slidably mounted in the switch body serves to close the switch when in contact with the ferrous rods and opens the switch when in contact with the ferrous disk at the opposite end.

BRIEF DESCRIPTION OF THE DRAWINGS

For a further understanding of the nature and objects of the present invention, reference should be had to the following description taken in conjunction with the accompanying drawings in which like parts are given like reference numerals and, wherein.

DETAILED DESCRIPTION OF THE PREFERRED EMBODIMENT

It is seen that the momentum activated switch of the present invention is designated generally by the numeral 10.

Figure 1:
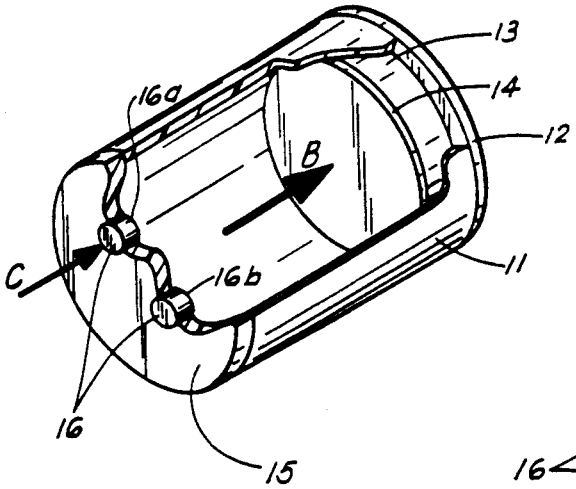
FIG. 1 is a partially cut-away view of the invention with magnet 13 shown at the "off" detent position.
Figure 2:
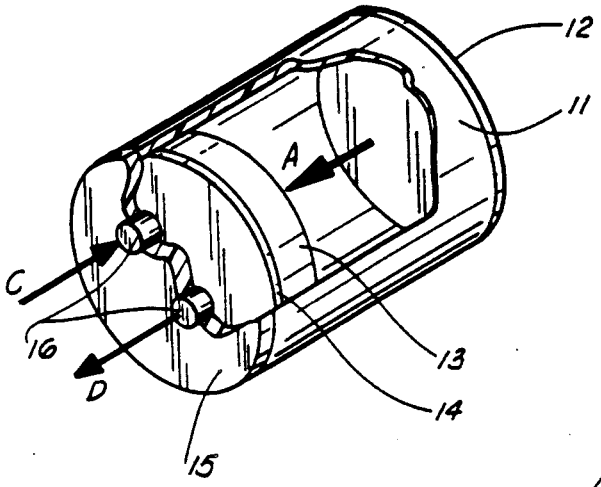
FIG. 2 is a partially cut-away view of the invention with magnet 13 shown at the "on" detent position.

As seen in FIGS. 1 and 2, switch body 11 is formed in a cylindrical shape in the preferred embodiment, but may also be of any shape suitable to the application in which it is used. Switch body 11 is formed from a non-magnetic and non-conducting material so as not to interfere with magnetic forces and magnetic detent functions which will be later explained.

Figure 3:
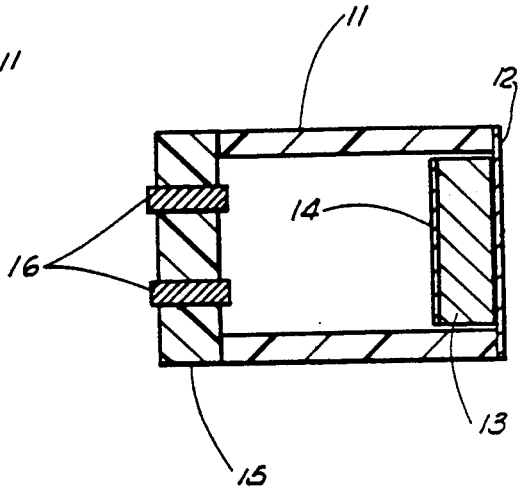
FIG. 3 is a side sectional view of the invention with the magnet 13 shown at the "off" detent position; and, FIG. 4 is a side sectional view of the invention with the magnet 13 shown at the "on" detent position.

As best seen in FIGS. 1 and 3, ferrous disk 12 is attached to or located at the first or "off" end of the switch body 11.

Figure 4:
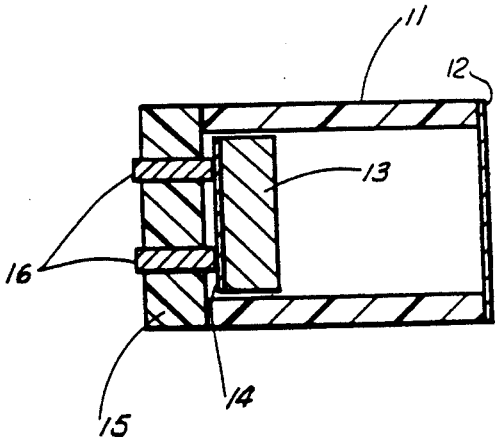

Contact end 15, the second end of switch body 11, best seen in FIGS. 2 and 4, is formed of non-magnetic and electrical non-conducting material and is located at the "on" end of the switch body 11.

Two ferrous rods 16 extend through and are attached to contact end 15. These rods 16 serve as electrical switch contacts on the inside of the switch body 11 and electrical switch terminals on the outside thereof.

Magnet 13 is a movable mass which is constrained to move (ARROW A of FIG. 2) easily between the "off" end and the "on" end within switch body 11. Magnet 13 may be formed from electrical conducting alloy or from non-conducting composition. When formed from non-conducting composition, disk 14 (best seen in FIGS. 3 and 4) formed from an electrical conducting material, is attached to the face of magnet 13 adjacent to the "on" position by any suitable means such as cementing. In an alternate embodiment, when magnet 13 is formed from electrical conducting alloy, disk 14 is omitted and the magnet 13 itself presents an electrical conducting face to the "on" end of the switch.

When magnet 13 is at the "off" end (FIGS. 1 and 3) a detent force is there exerted as a result of the mutual attraction between the ferrous disk 12 and the magnet. When magnet 13 is at the "on" end (FIGS. 2 and 4) a detent force is there exerted as a result of the mutual attraction between the two ferrus rods 16 and the magnet 13. The detent force at the "on" end is most particularly important as it serves to keep the conducting face of the magnet 13 in tight contact with the inside ends of the ferrous rods 16 which are the switch contacts. Thus the switch 10 is held closed reliably with virtually zero electrical resistance between the outside ends of the ferrous rods 16 which serve as the switch terminals.

Assume that magnet 13 is positioned at the "off" detent end of the Momentum Activated Switch 10 as shown in FIGS. 1 and 3. In FIG. 1 the ARROW C pointing in at the upper terminal 16*a* indicates that an electromotive force is there present. Since the switch is "off" no current can flow through to the other or lower terminal 16*b*. Acceleration of the switch body in the direction of the "on" end (ARROW A) combined then with a sufficiently abrupt deceleration results in the momentum of magnet 13 exerting an inertial force greater than and in opposition to the detaining force exerted between magnet 13 and ferrous disk 12. Magnet 13 is then released from the "off" detent position and moves to the "on" detent position. This is indicated by the ARROW A in FIG. 2.

As best shown in FIGS. 2 and 4, magnet 13 is now at the "on" detent position. The magent (or the electrical conducting disk 14 if used) is now held in firm contact with the two ferrous rods 16. This permits the free flow of current from the upper terminal 16*a* through the switch to the lower terminal 16*b* as shown by the arrows in FIG. 2.

Switching from the "on" to the "off" condition is accomplished in the reverse way as indicated by the ARROW B in FIG. 1.

While a movable magnet 13 is the most important part of the switch 10, it should be noted that the switch 10 is not magnetically activated. The switch 10 is momentum activated. The movable magnet 13 has three functions:

a. It is the mass which is accelerated and abruptly decelerated to operate the switch 10.

b. The mutual attraction between the magnet 13 and the ferrous material at each end of the switch 10 establishes effective detents at both ends.

c. It is (or carries) electrical conducting disk 14 which closes the contacts 16 at the "on" end of the switch 10 (FIGS. 2 and 4).

The size and proportions of the switch 10 may be varied over a large range depending upon the magnitude of the electrical current to be carried, space limitations and other factors dictated by the conditions under which it is used. One model of the switch 10 has been made having a diameter of ⅜" and a length of ¼". If space limitations demanded an even smaller switch 10, a further reduction in size could readily be made.

The parts comprising the switch 10 may be proportioned to provide a wide range of sensitivities. Generally a less sensitive switch 10 will require that it be accelerated to a higher velocity and be decelerated more abruptly to cause activation of the switch 10. A more sensitive switch will be accelerated to a lower velocity and less abruptly decelerated to cause activation. A less sensitive switch 10, for example, could employ a smaller and/or more powerful magnet 13 in conjunction with an increase in thickness of the ferrous disk 12 at the "off" end and an increase in size of the ferrous rods 16 at the "on" end. A more sensitive switch 10 would employ a larger and/or less powerful magnet 13 in conjunction with a reduction in thickness of the ferrous disk 12 at the "off" end and a decrease in size of the ferrous rods 16 at the "on" end. The parts may also be proportioned to make the switch 10 more sensitive when activated "on" and less sensitive when activated "off" or vice versa.

The switch 10 lends itself to be readily encapsulated in a sealed container for operation when immersed in fluids, gases, vapors and dusty environments.

Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in a limiting sense.

What is claimed as invention is:

1. A momentum activated electrical switch, comprising:

(a) a switch body;

(b) a first end of said body formed from ferrous material defining first detent in said switch body;

(c) a second end of said switch body formed from non-magnetic and electrically non-conductive material having two spaced-apart ferrous electrically conductive rods extending therethrough, an exterior end of each of said rods outside said switch body for connecting to an electrical circuit, an interior end of each of said rods inside said switch body cooperating together to define a second detent within said switch body adjacent said second end;

(d) a magnet positioned in said switch body and movable between said first and second detents by a combined acceleration and deceleration of said switch body sufficient to break the detaining force between said magnet and said respective detent; and, means associated with said magnet for connecting said rods in electrical communication when said magnet is positioned at said second detent, whereby said electrical switch is open when said magnet is at said first detent and closed when said magnet is at said second detent.

2. The switch of claim 1, wherein said switch body is of a cylindrical shape.

3. The switch of claim 1, wherein said means comprises a disk of electrically conductive material attached to the face of said magnet adjacent said second detent.

4. The switch of claim 1, wherein said means is an electrically conductive alloy of which said magnet is formed.

* * * * *